US011891782B2

(12) United States Patent
Veasy

(10) Patent No.: US 11,891,782 B2
(45) Date of Patent: Feb. 6, 2024

(54) GROUND ENGAGING TOOL CONTROL SYSTEM AND METHOD

(71) Applicant: Deere & Company, Moline, IL (US)

(72) Inventor: David A. Veasy, Dubuque, IA (US)

(73) Assignee: Deere & Company, Moline, IL (US)

( * ) Notice: Subject to any disclaimer, the term of this patent is extended or adjusted under 35 U.S.C. 154(b) by 486 days.

(21) Appl. No.: 15/929,403

(22) Filed: Apr. 30, 2020

(65) Prior Publication Data

US 2021/0340735 A1 Nov. 4, 2021

(51) Int. Cl.
*E02F 3/84* (2006.01)
*E02F 9/26* (2006.01)
(Continued)

(52) U.S. Cl.
CPC ..... *E02F 9/262* (2013.01); *E02F 3/764* (2013.01); *E02F 3/765* (2013.01); *E02F 3/7613* (2013.01);
(Continued)

(58) Field of Classification Search
CPC . E02F 9/262; E02F 9/264; E02F 9/265; E02F 3/7677; E02F 3/844; E02F 3/84; E02F 3/845; E02F 3/7613; E02F 3/7618; E02F 3/764; E02F 3/7645; E02F 3/765; E02F 3/961; E02F 3/7604; E02F 3/7627; E02F 3/7631; E02F 9/205; E02F 3/7654; E02F 9/2246; E02F 9/204; E02F 3/7609; E02F 3/7668; G05B 2219/45012; G05B 2219/45017; B60W 2300/17
See application file for complete search history.

(56) References Cited

U.S. PATENT DOCUMENTS 3,880,243 A * 4/1975 Gurries ..... E02F 3/7604 172/784
3,899,028 A * 8/1975 Morris ..... E02F 3/764 172/4.5
(Continued)

FOREIGN PATENT DOCUMENTS

DE 102019211708 A1 2/2020
DE 102019211801 A1 2/2020
(Continued)

OTHER PUBLICATIONS

German Search Report issued in application No. DE102021204257.0 dated Feb. 4, 2022 (06 pages).

*Primary Examiner* — Edwin J Toledo-Duran

(57) ABSTRACT

A ground engaging tool control system including a first sensor system, a second sensor system, a first actuator system, a second actuator system, and an electronic data processor. The first and second sensor systems detect respective positions of a first ground engaging tool and a second ground engaging tool. The first actuator system is coupled to the first ground engaging tool and the second actuator system is coupled to the second ground engaging tool. The electronic data processor determines a target grade profile and generates two or more control signals to adjust target positions of the first ground engaging tool and the second ground engaging tool. The target position of the second ground engaging tool is determined based on at least one of a position of the first ground engaging tool or the comparison of a current grade profile and a desired grade profile.

14 Claims, 7 Drawing Sheets

(51) Int. Cl.
*E02F 3/96* (2006.01)
*E02F 3/76* (2006.01)

(52) U.S. Cl.
CPC ..... *E02F 3/7618* (2013.01); *E02F 3/7645* (2013.01); *E02F 3/844* (2013.01); *E02F 3/961* (2013.01); *E02F 3/7604* (2013.01)

(56) References Cited

U.S. PATENT DOCUMENTS 4,643,261 A * 2/1987 Long ..... E02F 3/845 15/82
6,904,979 B1 * 6/2005 Confoey ..... E02F 3/7604 172/799.5
8,521,371 B2 * 8/2013 Faivre ..... G05B 19/106 701/50
9,113,047 B2 * 8/2015 Onuma ..... E02F 9/24
9,809,956 B1 * 11/2017 Sherlock ..... E02F 3/841
9,938,689 B2 * 4/2018 Chaston ..... E02F 3/7604
10,066,367 B1 * 9/2018 Wang ..... E02F 9/265
11,142,890 B2 * 10/2021 Peat ..... E02F 3/765
2010/0108336 A1 * 5/2010 Thomson ..... E02F 9/2207 172/795
2011/0108294 A1 * 5/2011 Thomson ..... E02F 9/20 172/1
2014/0209047 A1 * 7/2014 Hagman ..... F02D 41/021 701/104
2016/0348785 A1 * 12/2016 Patenaude ..... F16H 61/0213
2017/0066324 A1 * 3/2017 Hertel ..... A01B 63/112
2017/0101762 A1 * 4/2017 Chaston ..... E02F 3/7636
2017/0226717 A1 8/2017 Cherney
2018/0038066 A1 2/2018 Gentle et al.
2018/0106014 A1 4/2018 Horstman et al.
2019/0078292 A1 3/2019 Ono
2019/0093313 A1 3/2019 Ono
2019/0338495 A1 11/2019 Harada et al.
2020/0048869 A1 * 2/2020 Christofferson ..... E02F 3/765
2020/0048870 A1 2/2020 Peat et al.
2020/0299934 A1 * 9/2020 Ono ..... E02F 3/7654
2022/0090353 A1 * 3/2022 Stenoish ..... E02F 3/7618
2023/0060128 A1 * 3/2023 Kamimae ..... E02F 3/7659

FOREIGN PATENT DOCUMENTS

WO 2017163823 A1 9/2017
WO 2017164053 A1 9/2017

* cited by examiner

GROUND ENGAGING TOOL CONTROL SYSTEM AND METHOD

RELATED APPLICATIONS

This Application relates to U.S. application Ser. No. 16/058,055, titled "SYSTEM AND METHOD OF SOIL MANAGEMENT FOR AN IMPLEMENT," filed Aug. 8, 2018, which is hereby incorporated by reference in its entirety.

FIELD OF THE DISCLOSURE

The present disclosure relates generally to ground engaging tool control systems, and more particularly to a ground engaging tool control system and method for a motor grader.

BACKGROUND OF THE DISCLOSURE

Work vehicles, such as a motor grader, can be used in construction and maintenance for grading terrain to a flat surface at various angles, slopes, and elevations. When paving a road for instance, a motor grader can be used to prepare a base foundation to create a wide flat surface to support a layer of asphalt. Each surface being graded includes surface irregularities and ground materials of different types.

Some motor graders are equipped with a front straight blade to knock down the material before it is put to finish grade by the moldboard under the machine. This allows the motor grader to be twice as productive in one pass. Drawbacks to the use of a straight front blade includes the inability of the operator to simultaneously direct the material in the same manner as that of the moldboard. Additionally, material can spill off both ends of the blade, detrimental cuts in V-ditches are made, and uneven distribution of the material also results. As such, there is a need in the art for an improved system that provides more precise grading operations and increases vehicle performance and efficiency.

SUMMARY OF THE DISCLOSURE

According to one embodiment of the present disclosure, a ground engaging tool control system is disclosed. The ground engaging tool control system includes a first sensor system, a second sensor system, a first actuator system, and a second actuator system, each communicatively coupled to an electronic data processor. The first sensor system is configured to detect a current position of a first ground engaging tool. The second sensor system is configured to detect a position of a second ground engaging tool, which may include a multi-positional blade. The first actuator system is coupled to the first ground engaging tool, and the second actuator system is coupled to the second ground engaging tool. The electronic data processor is configured to execute a comparison of a current grade profile and a desired grade profile and generate a first control signal for receipt by the first actuator system to adjust the first ground engaging tool to a first target position based on the comparison. The electronic data processor generates a second control signal for receipt by the second actuator system to adjust the second ground engaging tool to a second target position based on at least one of a position of the first ground engaging tool or the comparison.

According to another embodiment of the present disclosure, a work vehicle is disclosed. The work vehicle comprises at least one first ground engaging tool that is coupled to the work vehicle. A second ground engaging tool is coupled to the work vehicle forward of the at least one first ground engaging tool. A first sensor system is configured to detect a current position of the first ground engaging tool. The second sensor system is configured to detect a position of a second ground engaging tool, which may include a multi-positional blade. A first actuator system is coupled to the first ground engaging tool, and a second actuator system is coupled to the second ground engaging tool. The electronic data processor is configured to execute a comparison of a current grade profile and a desired grade profile and generate a first control signal for receipt by the first actuator system to adjust the first ground engaging tool to a first target position based on the comparison. The electronic data processor generates a second control signal for receipt by the second actuator system to adjust the second ground engaging tool to a second target position based on at least one of a position of the first ground engaging tool or the comparison.

According to another embodiment of the present disclosure a method is disclosed. The method includes comparing a current grade profile and a desired grade profile, determining a first target position of a first ground engaging tool based on the comparison, determining a second target position of a second ground engaging tool based on at least one of the comparison or the first target position, and adjusting a position of the first ground engaging tool to the first target position to perform a first grading operation and adjusting the second ground engaging tool to the second target position to perform a second grading operation.

The above and other features will become apparent from the following description and accompanying drawings.

BRIEF DESCRIPTION OF THE DRAWINGS

The detailed description of the drawings refers to the accompanying figures in which.

Like reference numerals are used to indicate like elements throughout the several figures.

DETAILED DESCRIPTION OF THE DRAWINGS

Figure 1A:
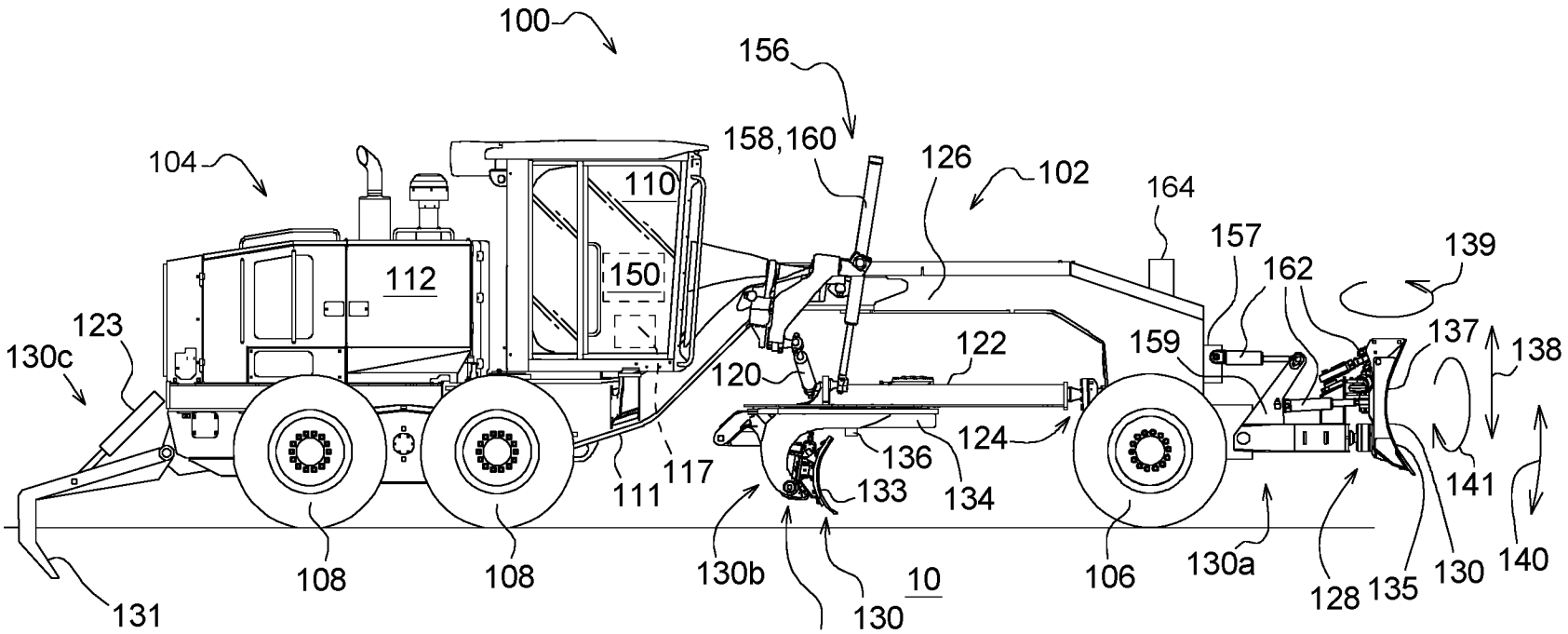
FIG. 1A is a side view of a work vehicle according to an embodiment.
Figure 1B:
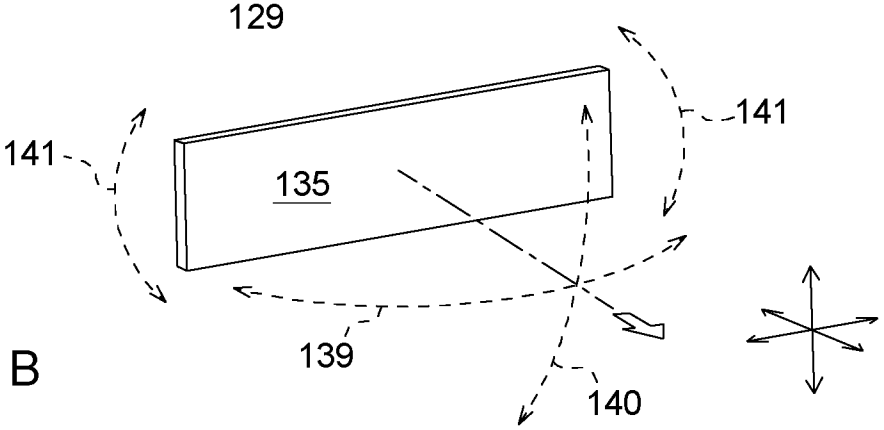
FIG. 1B is a front perspective view of a multi-positional blade coupled to the work vehicle of FIG. 1A.
Figure 2:
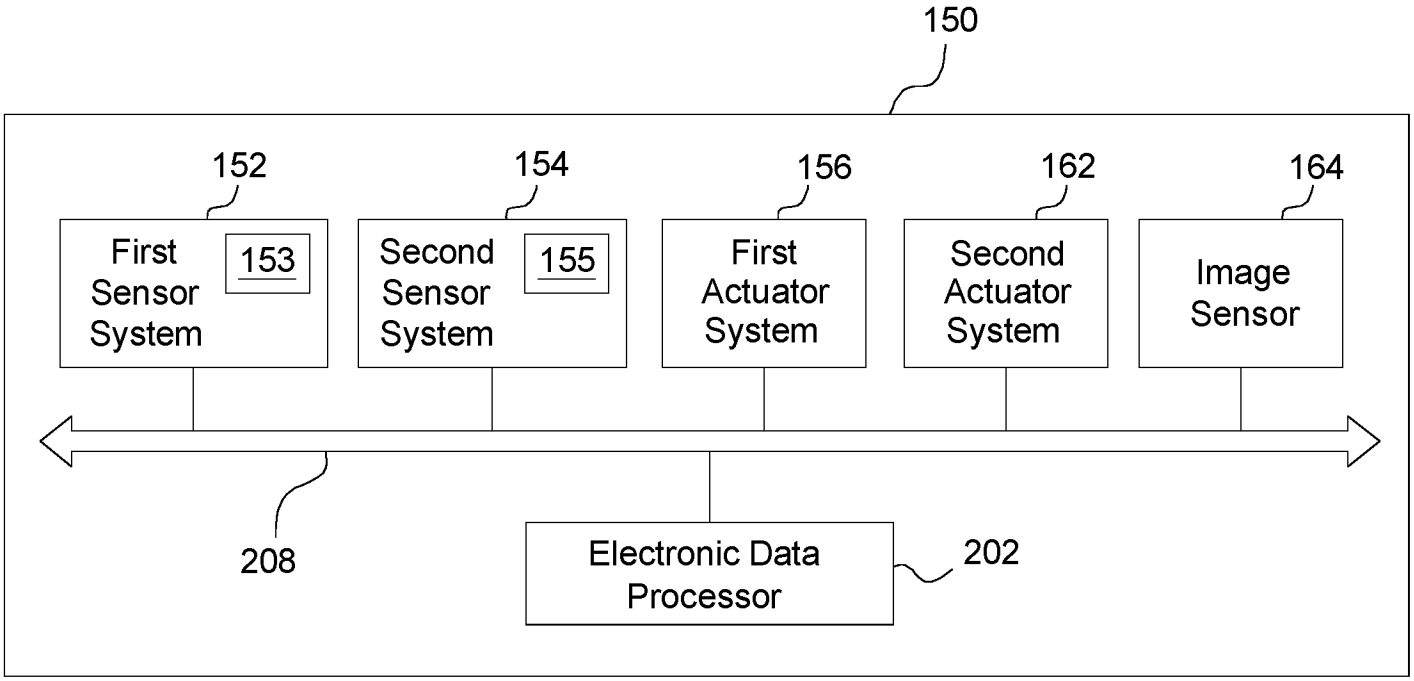
FIG. 2 is a block diagram of a ground engaging tool control system according to an embodiment.

Referring to FIGS. 1A-2, a work vehicle 100 including a ground engaging tool control system 150 is shown. Although in FIG. 1A the work vehicle 100 is shown as comprising a motor grader, it should be noted that, in other embodiments, the type of work vehicle 100 can vary according to application and/or specification requirements. For example, in some embodiments, the work vehicle 100 can comprise tracked or unmanned vehicles, and may also comprise road graders, dozers, bulldozers, and front loaders, with embodiments discussed herein being merely for exemplary purposes to aid in an understanding of the present disclosure.

As shown in FIG. 1A, the work vehicle 100 may comprise a front frame 102 and a rear frame 104, with the front frame 102 being supported on a pair of front wheels 106 and the rear frame 104 being supported on right and left tandem sets of rear wheels 108. In various embodiments, the design of the front frame 102 and/or rear frame 104 may vary based on application requirements. For example, in some embodiments such as that shown in FIG. 1A, the front and rear frames 102, 104 may comprise rigid frames, whereas, in other embodiments, each may comprise articulated frames.

An operator cab 110 can be mounted on an upwardly and inclined rear region 111 of the front frame 102 and may contain various hand-operated controls such as steering or level controls that can be accessed by a vehicle operator to control the operation of the work vehicle 100 and implements attached thereto. A user interface 117 can be arranged in the operator cab 110 and can comprise one or more user displays 210 (FIG. 3) with screens that provide the vehicle operator with machine data, image data, or selectable menus for controlling various features of the work vehicle 100.

An engine 112 is mounted on the rear frame 104 and supplies power for all driven components of the work vehicle 100. For example, the engine 112 can be configured to drive a transmission (not shown) that drives the rear wheels 108 at various selected speeds in forward or reverse modes. Mounted to a front of the front frame 102 is a drawbar 122, having a forward end universally connected to the front frame 102 by a ball and socket arrangement 124 and having opposite right and left rear regions suspended from an elevated portion 126 of the front frame 102.

With continued reference to FIG. 1A, the work vehicle 100 may comprise one or more ground engaging tools 130 (e.g., implements) that are arranged to perform a variety of ground preparation tasks. The ground engaging tools 130 may comprise a moldboard. The ground engaging tools 130 may be a first ground engaging tool 128 or a second ground engaging tool 129. In some embodiments, the ground engaging tools 130 may be positioned at different points along the work vehicle, for example, the ground engaging tools 130 may comprise a front ground engaging tool 130*a*, a mid ground engaging tool 130*b*, or optionally a rear ground engaging tool 130*c*. The rear ground engaging tool 130*c* can comprise a ripper/scarifier 131 mounted to a rear of the work vehicle 100 and can be arranged to work the ground prior to grading operations. Movement of the rear ground engaging tool 130*c* can be controlled via a rear actuator 123. The rear actuator 123 may comprise one or more hydraulic cylinders, pneumatic cylinders, electronic actuators, or combinations thereof. Although the rear ground engaging tool 130*c* is shown as including the ripper/scarifier 131, it should be noted that the non-limiting example of FIG. 1A is provided merely for exemplary purposes. In other embodiments, the rear ground engaging tool 130*c* can comprise a moldboard or other suitable tools according to application and/or specification requirements.

The mid ground engaging tool 130*b* may comprise a mid grading blade 133 coupled to the front frame 102 that is powered by a circle drive assembly 134. The circle drive assembly 134 may comprise a rotation sensor 136 including one or more switches that detect movement, speed, or position of the mid grading blade 133 relative to the front frame 102. The elevation of the mid grading blade 133 may be controlled by at least one first actuator system 156. In some embodiments, the first actuator system 156 may comprise right and left lift linkage arrangements 158, 160 that are arranged to support the drawbar 122. The right and left lift linkage arrangements 158 and 160 may be extended or retracted in an upward or downward motion to facilitate movement of the drawbar 122. In some embodiments, the first actuator system 156 may further comprise a side actuator 120, which induces lateral motion of the drawbar 122 to adjust a slope of the mid grading blade 133. The right and left linkage arrangements 158, 160 and the side actuator 120 may comprise hydraulic cylinders, pneumatic cylinders, electronic actuators, or combinations thereof.

With reference to FIGS. 1A and 1B, the front ground engaging tool 130*a* may comprise a multi-positional blade 135, such as a power-angle-tilt blade having multiple degrees of rotation and motion, arranged forward of the mid grading blade 133. For example, the multi-positional blade 135 may be a six-position power-angle-tilt blade 137 configured to move or rotate bidirectionally in at least one of a blade elevation direction 138, a blade angle direction 139, blade tilt direction 140, or a blade roll direction 141. In some embodiments, the multi-positional blade 135 may be movably coupled to a mounting portion 157 via a second actuator system 162 which moves or rotates the blade 135 in a lift, tilt, angle, or roll direction. For example, the second actuator system 162 may hydraulically actuate the multi-positional blade 135 to move vertically up or vertically down in the blade lift/elevation direction 138, pitch up or pitch down in the blade tilt direction 140, and yaw left or yaw right in the blade angle direction 139, and roll left or roll right in the blade roll direction 141. The second actuator system 162 may comprise hydraulic cylinders, pneumatic cylinders, electronic actuators, or combinations thereof.

Each of the mid grading blade 133 and multi-positional blade 135 may be configured to cut, separate, or transport ground material across a worksite 10. For example, as the work vehicle 100 travels across the worksite 10, each of the blades 133, 135 can be arranged to collect ground material such as soil, dirt, snow, and gravel from the terrain and move the collected ground material to different locations. It should be further noted that the arrangement of the multi-positional blade 135 is particularly advantageous in that it provides improved transport control through its increased range of motion (e.g., 6-way movement) that allows for several tasks to be completed simultaneously. For example, the multi-positional blade 135 may create features on the ground, including flat areas, grades, elevated areas such as hills, roads, or more complexly shaped features.

Figure 3:
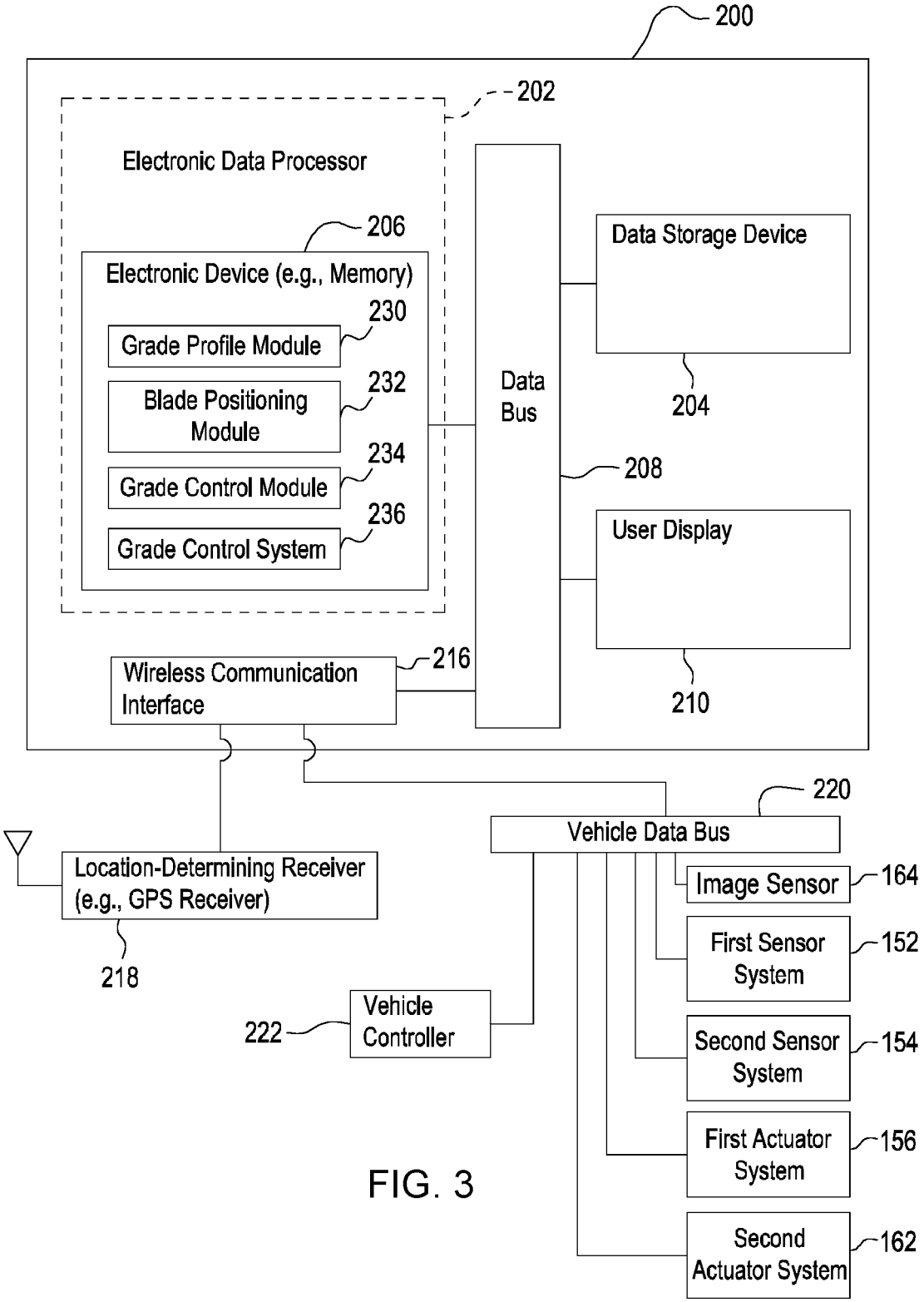
FIG. 3 is a block diagram of a vehicle electronics unit according to an embodiment.

Referring now to FIGS. 2 and 3, the ground engaging tool control system 150 may comprise each of the first and second actuator systems 156, 162, a first sensor system 152, a second sensor system 154, and an image sensor 164 or other perception sensor, each communicatively coupled to an electronic data processor 202. In some embodiments, the first sensor system 152 may comprise one or more first sensors 153 removably or fixedly coupled to either or both of the rear ground engaging tool 130*c* and the mid ground engaging tool 130*b*. The one or more first sensors 153 may comprise position or slope sensors, GPS (e.g., location determining receiver 218), angle sensors, rotation sensors, linear sensors, gyroscopes, accelerometers, inertial measurement units, or other suitable devices configured to detect an actual position of the rear ground engaging tool 130*c* or the mid ground engaging tool 130*b* relative to the work vehicle 100. Alternatively, the one or more first sensors 153 may detect a position indicative of the actual position of the rear ground engaging tool 130*c* or the mid ground engaging tool 130*b* relative to the work vehicle 100.

The second sensor system 154 may comprise one or more second sensors 155 removably or fixedly coupled to the front ground engaging tool 130*a*. The one or more second sensors 155 are configured to detect a position of the multi-positional blade 135. Alternatively, the one or more second sensors 155 may detect a position indicative of the actual position of the second ground engaging tool 129, or multi-positional blade 135. The one or more second sensors 155 may comprise a GPS (e.g., location determining receiver 218), lidar system, radar system, vision system, gyroscopes, accelerometers, inertial measurement units, or other suitable devices that measure angular velocities or linear acceleration of the multi-positional blade 135. For example, in some embodiments, the second sensors 155 may be configured to detect a tilt angle of the multi-positional blade 135 by measuring linear acceleration in three substantially perpendicular axes to determine the tilt angle based on a direction of gravity.

The electronic data processor 202 may be arranged locally as part of a vehicle electronics unit 200 of the work vehicle 100 (FIG. 3) or remotely at a remote processing center (not shown). In various embodiments, the electronic data processor 202 may comprise a microprocessor, a microcontroller, a central processing unit, a programmable logic array, a programmable logic controller, other suitable programmable circuitry that is adapted to perform data processing and/or system control operations. For example, the electronic data processor 202 may receive data signals from each of the first sensor system 152, the second sensor system 154, and the image sensor 164 to determine an optimal blade position.

As will be appreciated by those skilled in the art, FIGS. 1A-3 are provided for illustrative and exemplary purposes only and are in no way intended to limit the present disclosure or its applications. In other embodiments, the arrangement and/or structural configuration of the various system and vehicle components may vary. For example, in some embodiments, the structural arrangement and quantity of the ground engaging tools 130 may vary according to design and specification requirements. Although in embodiments discussed herein, the work vehicle 100 is shown as comprising three ground engaging tools 130, in other embodiments, the work vehicle may comprise fewer or more ground engaging tools 130 as well as variations in the type of tool used. For example, in some embodiments, the ground engaging tools 130 may comprise a dual blade arrangement including the front engaging tool 130*a* and either the rear or mid ground engaging tools 130*c*, 130*b* or other suitable configurations. Further, in still other embodiments, the ground engaging tool control system 150 may comprise additional sensors or other control devices mounted to an external or internal surface of the assemblies and components attached thereto.

Referring now to FIG. 3, the vehicle electronics unit 200 is shown according to an embodiment. The vehicle electronics unit 200 may comprise the electronic data processor 202, a data storage device 204, an electronic device 206, a wireless communications device 216, a user display 210, a location determining receiver 218, and a vehicle data bus 220 each communicatively interfaced with a data bus 208. As depicted, the various devices (i.e., data storage device 204, wireless communications device 216, user display 210, and vehicle data bus 220) may communicate information, such as sensor signals, over the data bus 208 to the electronic data processor 202.

The data storage device 204 stores information and data (e.g., geocoordinates or mapping data) for access by the electronic data processor 202 or the vehicle data bus 220. The data storage device 204 may similarly comprise electronic memory, nonvolatile random-access memory, an optical storage device, a magnetic storage device, or another device for storing and accessing electronic data on any recordable, rewritable, or readable electronic, optical, or magnetic storage medium.

The location-determining receiver 218 may comprise a receiver that uses satellite signals, terrestrial signals, or both to determine the location or position of an object or the vehicle. In one embodiment, the location-determining receiver 218 comprises a Global Positioning System (GPS) receiver with a differential correction receiver for providing precise measurements of the geographic coordinates or position of the vehicle. The differential correction receiver may receive satellite or terrestrial signal transmissions of correction information from one or more reference stations with generally known geographic coordinates to facilitate improved accuracy in the determination of a location for the GPS receiver. In other embodiments, localization and mapping techniques such as simultaneous localization and mapping (SLAM) may be employed. For example, in low receptivity areas and/or indoor environments such as caves, mines, or urban worksites, SLAM techniques may be used to improve positioning accuracy within those areas.

The electronic data processor 202 manages the data transfer between the various vehicle systems and components, which, in some embodiments, may include data transfer to and from a remote processing system (not shown). For example, the electronic data processor 202 collects and processes data (e.g., ground topography data, grade profile data, and mapping data) from the data bus 208 for transmission either in a forward or rearward direction.

The electronic device 206 may comprise electronic memory, nonvolatile random-access memory, flip-flops, a computer-writable or computer-readable storage medium, or another electronic device for storing, retrieving, reading or writing data. The electronic device 206 may include one or more software modules that records and stores data collected by the first sensor system 152, the second sensor system 154, the image sensor 164, or other network devices coupled to or capable of communicating with the vehicle data bus 220. In some embodiments, one or more software modules may include a grade profile module 230, a blade positioning module 232, or optionally a grade control module 234, each comprising executable software instructions or data structures that is processed by the electronic data processor 202.

The term module as used herein may include a hardware and/or software system that operates to perform one or more functions. Each module may be realized in a variety of suitable configurations and should not be limited to any particular implementation exemplified herein, unless such limitations are expressly called out. Moreover, in the various embodiments described herein, each module corresponds to a defined functionality; however, in other embodiments, each functionality may be distributed to more than one module. Likewise, in other embodiments, multiple defined functionalities may be implemented by a single module that performs those multiple functions, possibly alongside other functions, or distributed differently among a set of modules than specifically illustrated in the examples herein.

The grade profile module 230 may record and store real-time imaging data collected by the image sensor 164. For example, the grade profile module 230 may generate two-dimensional or three-dimensional grade profiles of the ground material based on the images captured. Additionally, in some embodiments, the grade profile module 230 may also associate color data, location data, environmental data, and/or ground characteristics (e.g., moisture or temperature characteristics) with the grade profile. The grade profiles may vary based on the type of ground material that is collected or transported. For example, the ground material may vary based on worksite operations and conditions and may include, without limitation, materials such as soil, rock, pebble, stone, minerals, organic matter, clay or vegetation.

The blade positioning module 232 may determine an optimal blade position of the multi-positional blade 135 and the mid grading blade 133 based on the generated grade profile. For example, the blade positioning module 232 may output command signals received by the first and second actuator systems 156, 162 to adjust a position of the multi-positional blade 135 in coordination with the mid grading blade 133 based on a desired grade profile. Such control and positional arrangement of the blades 133, 135 is particularly advantageous in that it allows for optimal displacement of the ground material as it is collected or moved, as well as improves vehicle efficiency. In other embodiments, an orientation and/or position of the multi-positional blade 135 and the mid grading blade 133 can be controlled via the grade control module 234. For example, the grade control module 234 may utilize GPS and stored terrain data output by a grade control system 236 to adjust a position and orientation of the blades 133, 135. In still other embodiments, the blade positioning module 232 may be further configured to coordinate control of the rear ground engaging tool 130*c* in combination with either or both the multi-positional blade 135 and the mid grading blade 133.

A vehicle controller 222 may comprise a device for steering or navigating the work vehicle 100 and each of the ground engaging tools 130 based on feedback received from the first sensor system 152, the image sensor 164, and the second sensor system 154. For example, in some embodiments, the vehicle controller 222 may communicate with grade control system 236, which receives one or more position signals from the location determining receiver 218 to position the ground engaging tools 130. Upon receipt of the position signals, the grade control system 236 may determine a location of the mid grading blade 133 and the multi-positional blade 135 and generate command signals communicated to the vehicle controller 222 to change a position of at least one of the blades 133, 135 by actuating the first and second actuator systems 156, 162.

In other embodiments, the electronic data processor 202 may execute software stored in the grade control module 234 to allow for the position data to be mapped to the grade profiles or cross-referenced with stored maps or models. For example, in some embodiments, the grade control system 236 may comprise a collection of stored maps and models that may be used to determine a desired blade position.

Figure 4:
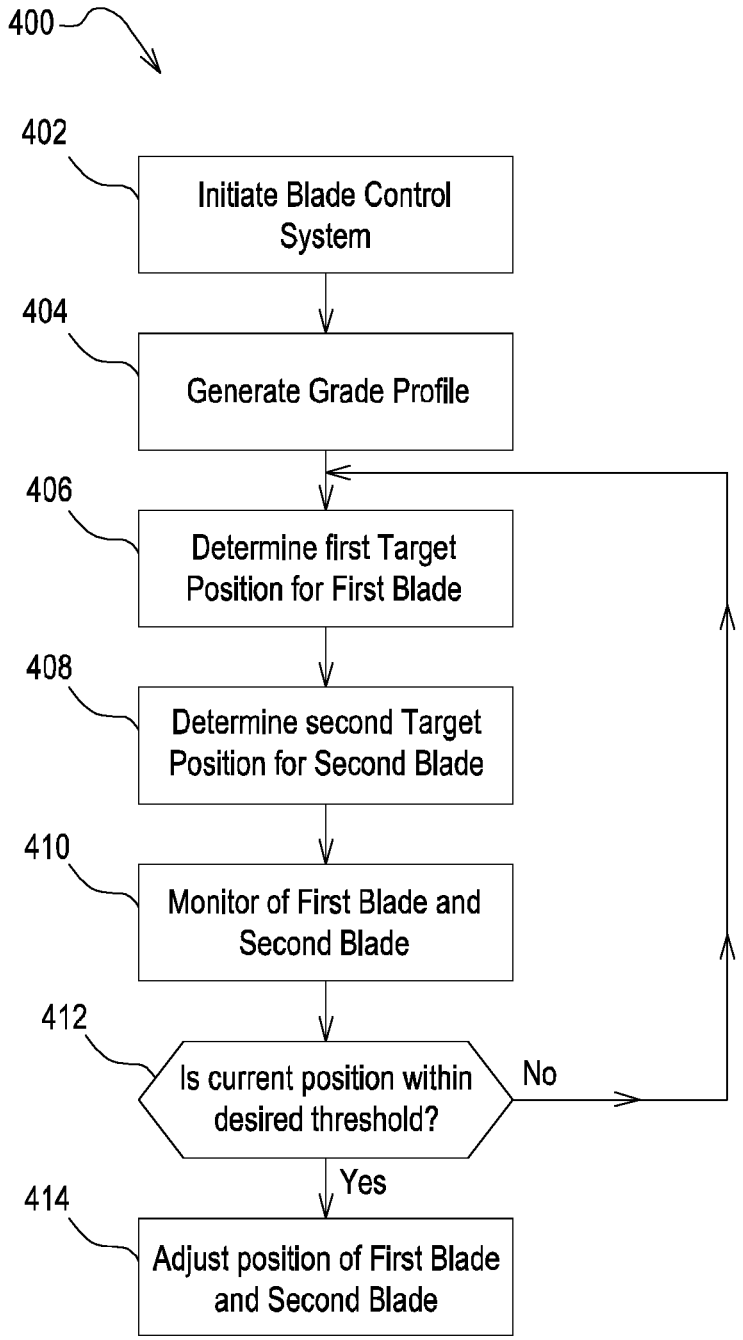
FIG. 4 is a flow diagram of a method for providing blade control.

Referring now to FIG. 4, a flow diagram of a method 400 for providing coordinated blade control for the ground engaging tool control system 150 is shown. At 402, upon start-up of the work vehicle 100 or upon activation by an operator via selection of a start input on the user interface 117 or the user display 210, the ground engaging tool control system 150 may be initiated and a desired grading operation and an initial target position may be set for all ground engaging tools 130. The desired grading operation may include surface smoothing, ditch creation, slope creation, or other operations. Since the multi-positional blade 135, the mid grading blade 133, and the rear ground engaging tool 130*c* may be independently controlled, the operator may select different grading operations and initial target positions for each of the blades 135, 133 and the rear ground engaging tool 130*c*.

As the work vehicle 100 travels across the worksite 10, the image sensor 164 captures a plurality of images of the worksite 10 and transmits the image data to the electronic data processor 202 for processing. The electronic data processor 202 may receive signals from the first and second sensor systems 152, 154 indicative of the actual position and target positions of the mid grading blade 133 and the multi-positional blade 135, which may be displayed on the user display 210.

At 404, a desired grade profile is generated by the grade profile module 230 based on a selected grading operation and the captured image data. For example, the operator may select one or more grading operations such as surface smoothing, surface shaping (e.g., ditch or slope creation), or road maintenance based on the captured image data.

Next at 406 and 408, the blade positioning module 232 may determine a first target position and a second target position for the mid grading blade 133 and the multi-positional blade 135, respectively, based on the determined grade profile and the selected grading operation. In some embodiments, the selected grading operation and grade profile may require two distinct tasks to be performed by each of the mid grading blade 133 and the multi-positional blade 135 in a single operation. For example, a first target position may be determined at 406 for the mid grading blade 133 to allow it to perform a first grading operation such as surface smoothing.

Figure 6:
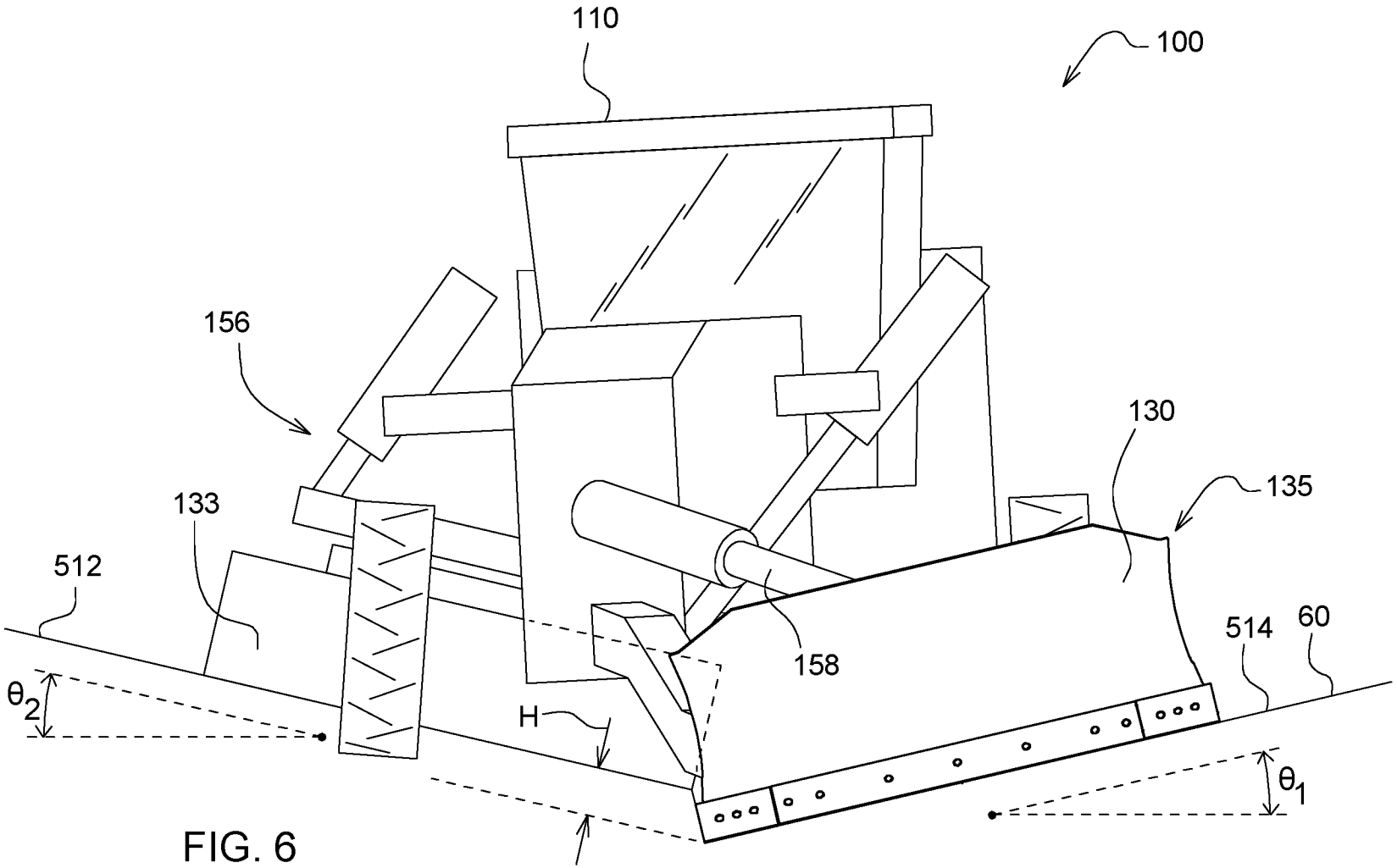
FIG. 6 is a front view of the work vehicle of FIG. 1A in operation utilizing the ground engaging tool control system of FIG. 2.

A second target position may be determined at 408 for the multi-positional blade 135 based on the first target position to allow it to perform a second grading operation such as slope creation in coordination with the first grading operation (FIG. 6). In other embodiments, the multi-positional blade 135 and the mid grading blade 133 may be positioned to perform the same grading operation with respective first and second target positions for each being determined. Additionally, as previously discussed, the rear ground engaging tool 130*c* may also be coordinated with either or both the mid grading blade 133 and the multi-positional blade 135, in some embodiments.

At 410, as the grading operations are being performed, current position data for each of the mid grading blade 133 and the multi-positional blade 135 is monitored by the first and second sensor systems 152, 154 and displayed on the user display 210. The current position data may correspond to an elevation, angle, or tilt of the one or more blades 133, 135.

Based on the received data, a decision is made at 412 to determine if the actual or current position data is outside a desired threshold range. For example, the electronic data processor 202 may compare the actual position to a predetermined threshold (target position set by operator or retrieved from data storage device 204) to determine if the actual position exceeds or falls below the predetermined threshold. If the actual position exceeds or falls below the predetermined threshold, the electronic data processor 202 may determine a new first and second target position for each of the mid grading blade 133 and the multi-positional blade 135 via the blade positioning module 232 and repeat steps 406-410.

For example, in one embodiment, the target position may be updated based on changes in the ground topography data output by the grade control module 236 or sensed via lidar or radar, for example. In response, the electronic data processor 202 may output command signals to the second actuator system 162 to control a height, tilt, and/or slope of the multi-positional blade 135 to the target position based on feedback received from the second sensor system 154. If the actual position exceeds or falls below the predetermined threshold, the electronic data processor 202 may automatically control the second actuator system 162 to adjust the height of the multi-positional blade 135 to the target position. In other embodiments, the operator may change the desired grading operation from surface smoothing to material shedding and enter a new target position to allow material to be shedded from one side of the multi-positional blade 135. In still other embodiments, the desired grading operations may be changed automatically based on data outputs received from the second sensor system 154.

It should be noted, however, that irrespective of the selected operation, the second target position may be coordinated with and determined based on the first target position. Such coordinated control is advantageous due to the increased range of motion (e.g., 6-way movement) of the multi-positional blade 135, which allows for elevation, angle, and tilt control of the multi-positional blade 135 to provide better control of the ground material. For example, the multi-positional blade 135 may be positioned at an elevated position to knock down hills or mounds in advance of the grade-setting operation performed by the mid grading blade 133, whereas the mid grading blade 133 or rear ground engaging tool 130*c* can be positioned to knock down the hill in a second pass.

Once the first and second target positions are determined, a position of each of the mid grading blade 133 and the multi-positional blade 135 is adjusted by the first and second actuator systems 156, 162 at 414. In other embodiments, the new target position may be set by the operator directly, such as through a switch, increment or decrement buttons which may modify the target position, or the operator may input the new position through the user display 210.

Figure 5:
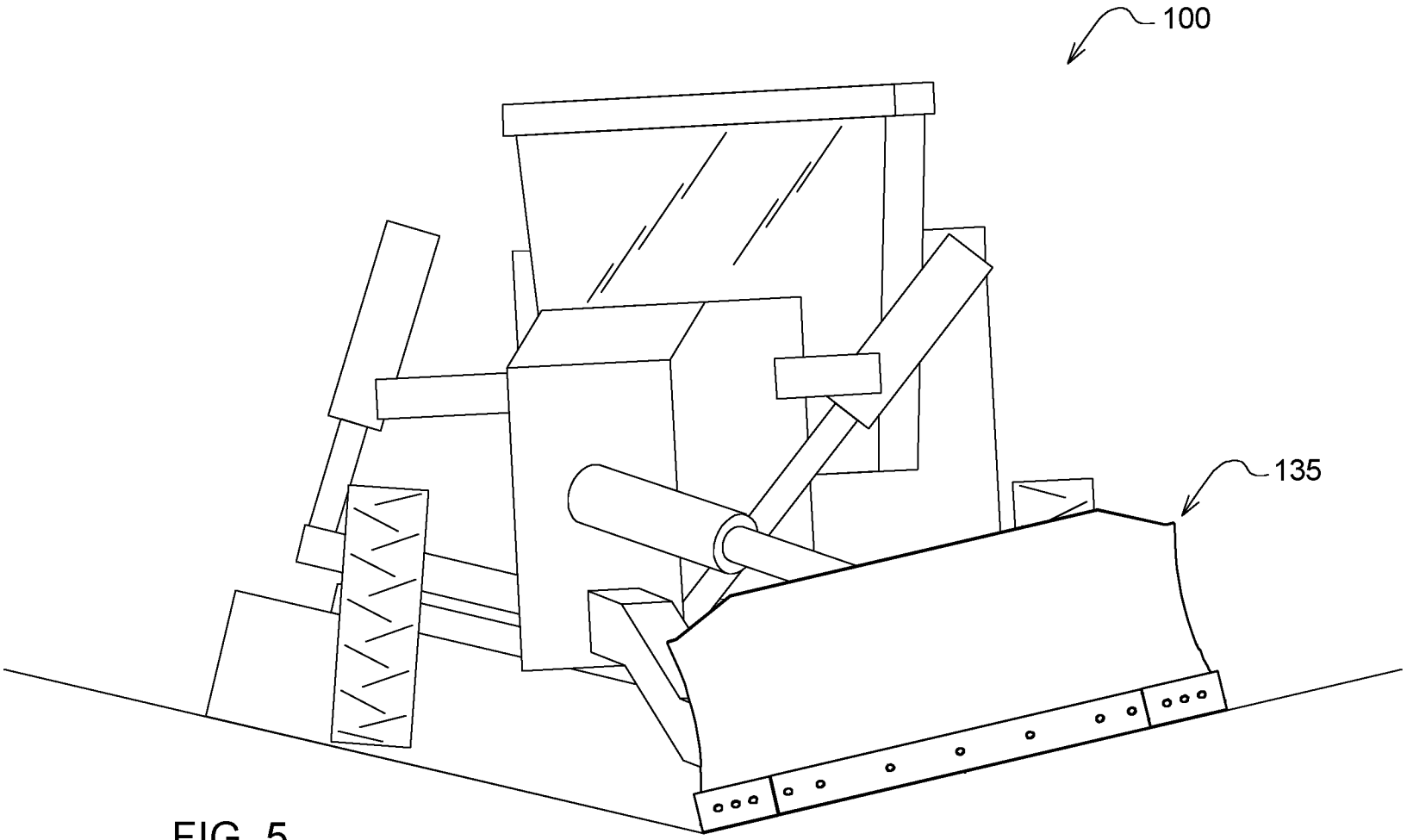
FIG. 5 is a front view of the work vehicle of FIG. 1A in operation utilizing the ground engaging tool control system of FIG. 2.
Figure 7:
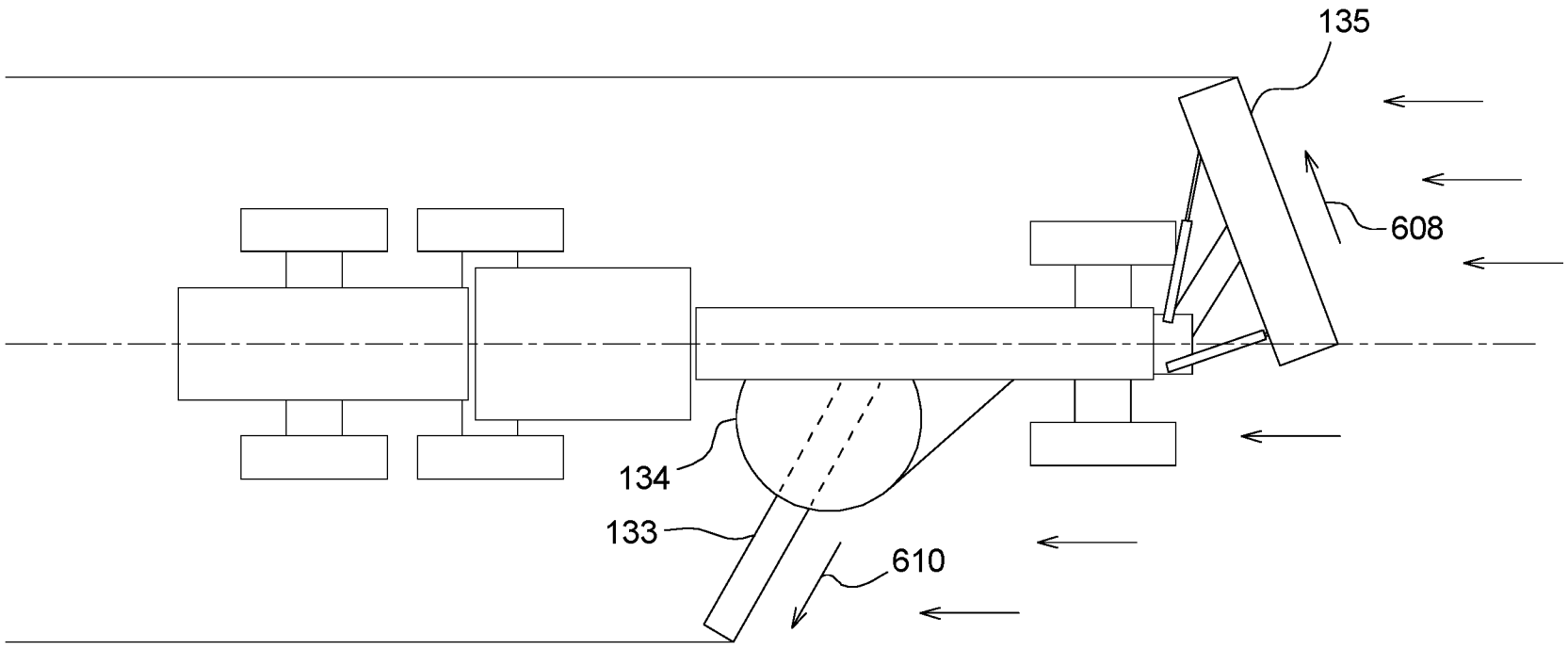
FIG. 7 is a front view of the work vehicle of FIG. 1A in operation utilizing the ground engaging tool control system of FIG. 2.

As shown in FIGS. 5-7, the dual and independent control of the mid grading blade 133 and the multi-positional blade 135 allows for multiple ground features to be created in a single pass. For example, in one embodiment, the multi-positional blade 135 may be oriented at a first slope angle (e.g., $\theta_1$) relative to ground 60 and the mid grading blade 133 can be oriented at a second angle ((e.g., $\theta_2$) relative to the ground 60 to create a ground feature such as the V ditch. In other examples, such as that shown in FIG. 6, the mid grading blade 133 and the multi-positional blade 135 can be controlled to different heights. As shown in FIG. 6, the mid grading blade 133 may be raised to a height H to allow for the mid grading blade 133 to move ground material in a first plane 512 which is at a higher elevation, and the multi-positional blade 135 may be oriented at a lower height to move ground material in a second plane 514. Additionally, referring now to FIG. 7, the mid grading blade 133 and the multi-positional blade 135 may also be positioned at different tilt angles to shed ground material engaged with the blades along a first path 608 and a second path 610.

Without in any way limiting the scope, interpretation, or application of the claims appearing below, a technical effect of one or more of the example embodiments disclosed herein is a system and method for providing blade control and coordinated blade control. The coordinated ground engaging tool control system is advantageous in that it improves vehicle efficiency and allows for optimal displacement of ground material as it is collected or moved by a work vehicle.

While the present disclosure has been illustrated and described in detail in the drawings and foregoing description, such illustration and description is not restrictive in character, it being understood that illustrative embodiment(s) have been shown and described and that all changes and modifications that come within the spirit of the present disclosure are desired to be protected. Alternative embodiments of the present disclosure may not include all the features described yet still benefit from at least some of the advantages of such features. Those of ordinary skill in the art may devise their own implementations that incorporate one or more of the features of the present disclosure and fall within the spirit and scope of the appended claims.

What is claimed is:

1. A ground engaging tool control system for a work vehicle, the ground engaging tool control system comprising:

a first sensor system configured to detect a position of a first ground engaging tool;

a second sensor system configured to detect a position of a second ground engaging tool;

a first actuator system coupled to the first ground engaging tool;

a second actuator system coupled to the second ground engaging tool; and an electronic data processor in communication with the first sensor system and the second sensor system and configured to execute a comparison of a current grade profile and a desired grade profile, generate a first control signal for receipt by the first actuator system to adjust the first ground engaging tool to a first target position based on the comparison, and generate a second control signal for receipt by the second actuator system to adjust the second ground engaging tool to a second target position based on a position of the first ground engaging tool and the comparison.

2. The ground engaging tool control system of claim 1, wherein the current grade profile is determined from a measured ground topography that is provided by an image sensor in communication with the electronic data processor.

3. The ground engaging tool control system of claim 1, wherein the second ground engaging tool comprises a multi-positional blade.

4. The ground engaging tool control system of claim 1, wherein adjusting the first ground engaging tool to the first target position comprises positioning the first ground engaging tool to perform a first grading operation, and wherein adjusting the second ground engaging tool to the second target position comprises positioning the second ground engaging tool to perform a second grading operation.

5. The ground engaging tool control system of claim 1, wherein the at least one first ground engaging tool comprises at least one of a mid grading blade or a rear ground engaging tool.

6. The ground engaging tool control system of claim 1, wherein the second ground engaging tool comprises a six-position power-angle-tilt blade.

7. The ground engaging tool control system of claim 6, wherein the six-position power-angle-tilt blade is configured to move bidirectionally in at least one of a blade elevation direction, a blade angle direction, a blade tilt direction, or a blade roll direction.

8. A work vehicle comprising:

a first ground engaging tool coupled to the work vehicle;

a second ground engaging tool coupled to the work vehicle forward of the first ground engaging tool;

a first sensor system configured to detect a position of the first ground engaging tool;

a second sensor system configured to detect a position of the second ground engaging tool;

a first actuator system coupled to the first ground engaging tool;

a second actuator system coupled to the second ground engaging tool; and an electronic data processor in communication with the first sensor system and the second sensor system and configured to execute a comparison of a current grade profile and a desired grade profile, generate a first control signal for receipt by the first actuator system to adjust the first ground engaging tool to a first target position based on the comparison, and generate a second control signal for receipt by the second actuator system to adjust the second ground engaging tool to a second target position based on a position of the first ground engaging tool and the comparison.

9. The work vehicle of claim 8, wherein the current grade profile is determined from a measured ground topography that is provided by an image sensor in communication with the electronic data processor.

10. The work vehicle of claim 8, wherein the second ground engaging tool comprises a multi-positional blade.

11. The work vehicle of claim 8, wherein adjusting the first ground engaging tool to the first target position comprises positioning the first ground engaging tool to perform a first grading operation, and wherein adjusting the second ground engaging tool to the second target position comprises positioning the second ground engaging tool to perform a second grading operation.

12. The work vehicle of claim 8, wherein the at least one first ground engaging tool comprises at least one of a mid grading blade or rear ground engaging tool.

13. The work vehicle of claim 8, wherein the second ground engaging tool comprises a six-position power-angle-tilt blade.

14. The work vehicle of claim 13, wherein the six-position power-angle-tilt blade is configured to rotate bidirectionally in at least one of a blade elevation direction, a blade angle direction, a blade tilt direction, or a blade roll direction.

* * * * *